United States Patent [19]

De Fockert

[11] Patent Number: 4,584,934

[45] Date of Patent: Apr. 29, 1986

[54] APPARATUS FOR PRODUCING A HOMOGENOUS FLEXIBLE LAYER OF MATERIAL FROM BLOCKS OF HIGHLY CONSISTENT MATERIAL, SUCH AS BUTTER OR MARGARINE

[75] Inventor: Gijsbert De Fockert, Herwijnen, Netherlands

[73] Assignee: Machinefabriek C. Rijkaart , B.V., Netherlands

[21] Appl. No.: 670,811

[22] Filed: Nov. 13, 1984

Related U.S. Application Data

[63] Continuation-in-part of Ser. No. 457,174, Jan. 11, 1983, abandoned.

[30] Foreign Application Priority Data

Nov. 19, 1982 [NL] Netherlands ..... 8200095

[51] Int. Cl.[4] ..... A01J 15/00; A01J 17/00

[52] U.S. Cl. ..... 99/462; 99/460; 99/466; 100/907; 366/300; 366/301; 418/192

[58] Field of Search ..... 99/452, 453, 455, 462, 99/460, 466; 100/907; 418/159, 192, 193; 425/225, 232, 202, 376 R; 222/270, 272, 342; 406/100, 102; 366/309, 312, 300, 301; 426/581–583, 34

[56] References Cited

U.S. PATENT DOCUMENTS

| | | | |
|---|---|---|---|
| 913,927 | 3/1909 | Tompkins | 418/192 |
| 3,205,838 | 9/1965 | Frobeen et al. | 100/907 X |
| 4,239,470 | 12/1980 | Sherman | 418/206 X |

*Primary Examiner*—Timothy F. Simone
*Attorney, Agent, or Firm*—J. Gibson Semmes

[57] ABSTRACT

An apparatus for producing a homogeneous flexible layer of material such as butter or margarine, comprising an input portion for guiding blocks of said material into a central portion, in which two rotors 11, 12 are arranged in a horizontal plane, a central region 33 between said rotors 11, 12 lying beneath said input portion and are driven in opposite directions, each rotor being provided with a number of axial blades 22, 23 radially displaceable in slots and guided by guiding means at the ends thereof.

4 Claims, 2 Drawing Figures

APPARATUS FOR PRODUCING A HOMOGENOUS FLEXIBLE LAYER OF MATERIAL FROM BLOCKS OF HIGHLY CONSISTENT MATERIAL, SUCH AS BUTTER OR MARGARINE

CROSS-REFERENCE TO RELATED APPLICATION

This Application is a continuation in part of my application Ser. No. 457,174 filed Jan. 11, 1983, now abandoned.

BACKGROUND AND SUMMARY OF THE INVENTION

The invention relates to an apparatus for producing a homogeneous flexible layer of material from blocks of highly consistent material, such as butter or margarine.

The layer consisting of butter or margarine obtained from such apparatus is intended to be put on top of a layer of dough or is to be laminated between several other layers.

Until now such a layer of butter or margarine was obtained by means of an apparatus of a type of the well-known mincer, which minces blocks of input raw material and conveys the minced material by an endless conveyor screw to an outlet aperture.

However, an important drawback of said known apparatus is that it is very difficult to obtain and to maintain an endless homogenous output layer with a thickness or vertical cross-section which is of uniform dimension. Other drawbacks of said known apparatus are, that it is very difficult to clean, which is an important item within food processing, and that it consumes too much drive power.

From U.S. Pat. No. 3,205,838 (Frobeen) an extrusion press for processing fats and dough is known comprising a pair of rotatably driven rotors, arranged in parallel in a horizontal plane, each rotor being provided with axially arranged slots in their outer surface, each of said slots having a blade which is controlled slideably in a radially direction, the blades being guided such that they project out of said rotors in an upper quarter region, while contacting or almost contacting the respective similar projected blade of the opposite rotor and, while turned down subsequently by continued rotation of the rotors, they are retracted subsequently and guided along a respective one of a pair of scraper elements, which form the upper border to a pressure room and which bear close against said rotors.

With the Frobeen apparatus the raw input material which, significantly has a low consistency and is fed into a hopper, which is arranged above said rotors, so that the raw input material is enabled to thus flow by gravity between the upper, projecting blades of said rotors and can thus be conveyed through the intermediate region between said rotors into said pressure room.

It is the object of the invention, on the contrary, to provide an apparatus for producing a homogeneous flexible layer of material from blocks of highly consistent material, such as butter or margarine, which apparatus does not have the drawbacks of said known apparatus.

Therefore, according to the invention, an apparatus is provided for producing a homogeneous flexible layer of flexible material from blocks of a highly consistent material, such as butter or margarine comprising: an upper input portion having a pair of substantially vertical, parallel extending sidewalls the edges of each defining the border of an upper input opening and of a lower output opening of said input portion, said sidewalls being arranged such as to guide said blocks of highly consistent material in close relationship in a vertical direction, which blocks are to be input into the upper opening of said input portion; a central portion comprising a housing having an upper inlet section and a lower outlet section, the inlet section being arranged opposite to and aligned with the output opening of said input portion, a pair of elongate rotors which are disposed in parallel in a substantially horizontal plane inside said housing, the rotors defining an intermediate conveying section in between, the rotors being rotatably driven by means of a drive mechanism such that the left rotor of said rotors is driven clockwise and the other rotor is driven counterclockwise, the distance between the axes of said rotors being greater than the distance between said sidewalls of the input portion at the output opening thereof, each rotor defining a number of rectangular slots which are formed in parallel to the axes of said rotors on the outer circumference thereof; each slot being provided with a blade, which is substantially radially displaceable with respect to the rotor, each blade being provided with guide elements at the most outer ends thereon which elements, during rotation of the rotor, are guided inside a pair of grooves, said grooves being formed opposite the respective ends of each of said rotors in the side walls of the housing, each such groove having a loop shape extending gradually in such a manner that the blades are retracted completely inside the corresponding slots when brought into said outlet section and the blades are extended elsewhere such and the rotors being disposed and driven such, that the blades of the opposed rotors mesh with each other and are close to the opposite rotor in said conveying section, while the blades can scrape slices of material from said blocks, which are to be placed on top of said rotors, and the blades convey said scraped material into said outlet section; and a lower output portion having two sidewalls which converge such as to define a rectangular input opening opposite to and aligned with the output section of said central portion and a smaller lower rectangular output opening, the upper edge of each of said side walls of said lower portion being provided with a scraper element which bears against the outer surface of a respective one of said rotors, thus said layer can be output homogenous from said apparatus through said output opening of said lower output portion.

With the apparatus of the invention the upper, projecting blades of each of said rotors grasp into the bottom parts of said blocks, so that the blades cut slices from said bottom parts, which are subsequently conveyed through the intermediate region between said rotors into the lower output portion. Because the blades of different rotors intermesh always in said intermediate region and bear against the respective opposite rotor, a pressure on said material to be treated in the output portion is built up, so that the layer thus obtained by extrusion from said output portion will be continuously homogenous and will have a thickness or vertical cross-section which is of uniform dimension. It is important therewith that the distance between the side walls of the input portion which are parallel to the rotor axis is less than the distance between said rotor axis.

Such an action is not possible with the Frobeen apparatus, because the many blades thereof cannot grasp engage or scrape into bottom parts of blocks of highly consistent material placed on top of such rotors, the blades of Frobeen more likely supporting said blocks than to cut them. This unique effect is even emphasized because a pair of upper side walls, of the invention wherein the lower edges are parallel to the rotors, converts downwardly to an output opening of said hopper whereby the dimension perpendicular to the rotor axis is greater than the distance between the axis of said rotors.

The apparatus according to the invention has a very high efficiency, and can be easily cleaned after use. Power consumption is relatively low.

For a better understanding of the invention and to show how the same may be carried out into effect, reference will now be made, by way of example, to the accompanying drawings, in which.

DESCRIPTION OF THE PREFERRED EMBODIMENT

Figure 1:
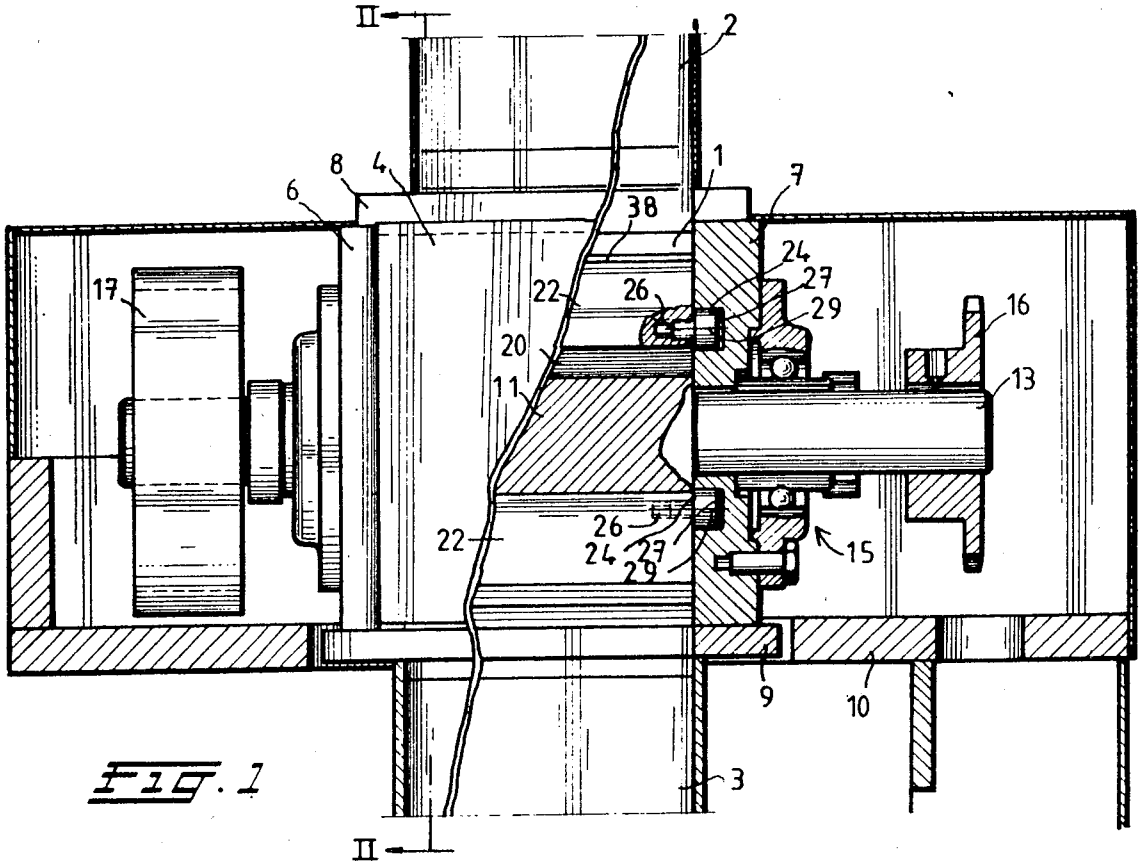
FIG. 1 is a front elevation of the apparatus in partial section.
Figure 2:
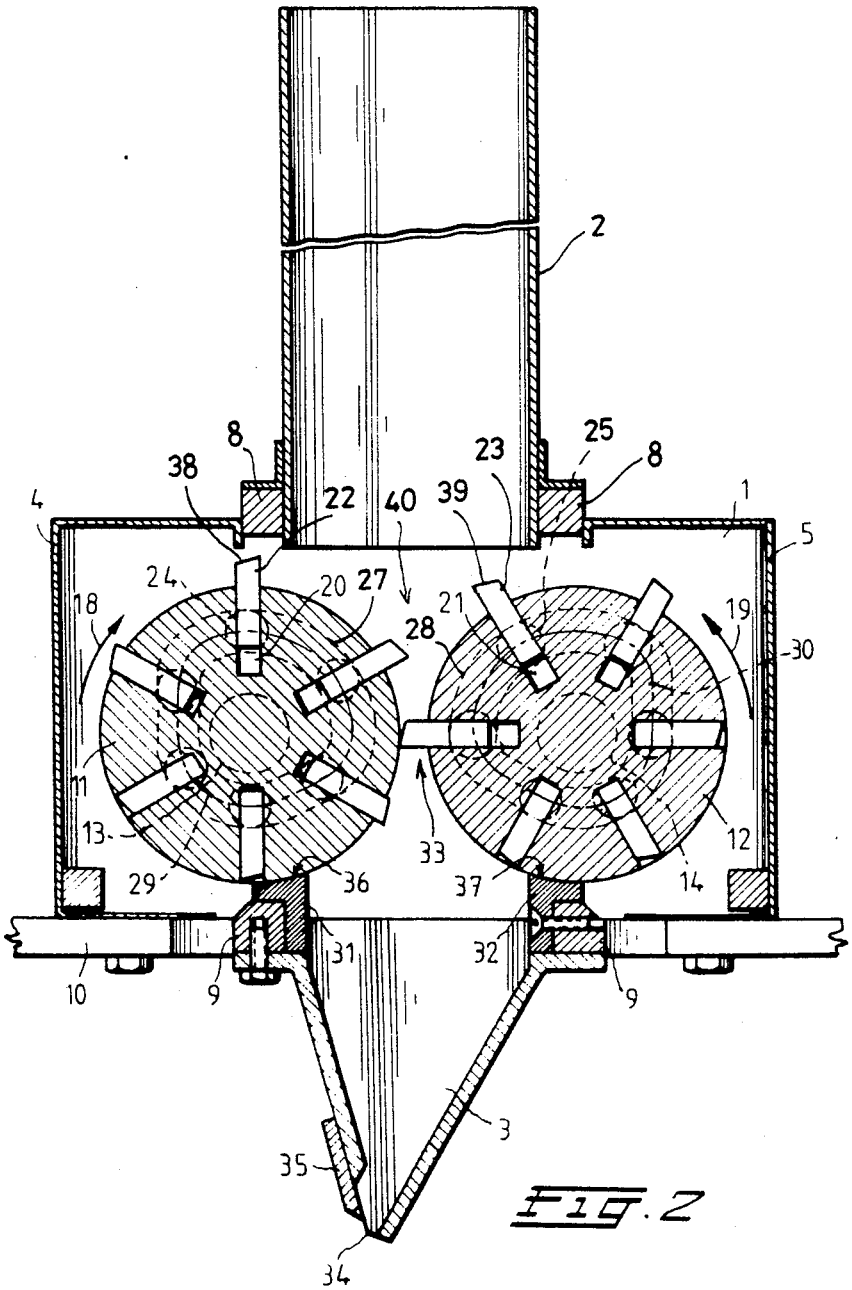
FIG. 2 is a cross-section of the apparatus according to FIG. 1 on the line II—II.

The preferred embodiment of the apparatus according to the invention as illustrated in FIGS. 1 and 2 comprising a central portion having a housing 1; an inlet portion 2; and an outlet portion 3. The housing 1 comprises a front wall 4, a rear wall 5, a left-hand side wall 6, and a right-hand side wall 7. Connecting members 8 connect the pump housing 1 to the inlet portion 2 and connecting members 9 connect the outlet portion 3 to the housing 1. The latter is secured to a frame 10.

Two parallel rotors 11 and 12 are disposed in parallel in a horizontal plane inside the housing 1 between the side walls 6 and 7. The rotors 11 and 12 are each rotatable around their axis by means of shafts, 13 and 14 respectively, which extend through the side walls 6 and 7. Each shaft 13, 14 is provided with bearing elements 15 secured to the side walls 6, 7 of the pump housing 1. One of the shafts, e.g. shaft 13 of rotor 11, is provided at one end with a gearwheel 16 co-operating with a chain co-operating with a drive mechanism. Those ends of the shafts 13 and 14 which are situated at the other side of the housing 1 are each provided with a gear-wheel 17, the gearwheels intermeshing. The drive mechanism forces the shaft 13 through the chain to rotate such that the rotors are rotated in the direction of the arrows 18 and 19, i.e. the left rotor clockwise and the right rotor counterclockwise.

Each rotor 11, 12 is provided with a number of axial slots 20, 21 respectively which are formed in the circumference of the rotors and in which elongate blades 22 and 23 respectively are received and are displaceable radially with respect to the rotors 11 12.

The blades 22, 23 of each rotor 11, 12 are arranged such and the rotors 11, 12 are driven such, that the blades always intermesh in the central region 33 between the rotors 11, 12.

At each end situated opposite the side walls 6, 7 of the housing 1 each blade 22, 23 is provided with axially projecting guide elements 24 and 25 respectively which in this embodiment are each formed by a ball- bearing wheel connected by a screw 26 to the respective end of the blade 22 or 23. The guide elements 24, 25 provided at either side of each blade are guided inside corresponding grooves 27 for the rotor 11 and grooves 28 for the rotor 12 having the axis 29 and 30 respectively, said grooves 27 and 28 being formed in the side walls 6 and 7 of the housing 1.

The grooves 27, 28 have a gradually extending shape such that the blades 22, 23 project radially out of the rotors 11, 12 in the zone where the inlet portion 2 leads into the pump housing 1 while they are retracted completely inside the rotors 11 and 12 respectively in the zone where the housing 1 leads into the outlet portion 3, where scraper elements 31, 32 secured to the upper edge of downwards converging sidewalls of the outlet portion 3 bear against outer surface of the rotors 11, 12 respectively. In the central region 33 between the rotors 11, 12 the blades 22 and 23 respectively are preferably so extended that the projecting ends thereof bear against the opposite rotor 12, 11 respectively.

During operation, of the apparatus according to the invention, blocks of highly consistent material, such as butter and margarine having a temperature of for instance less than 15° C., are placed in the input portion 2. Several blocks may be stacked on to each other. Each block is guided such in a vertical direction by the walls of input section 2, which extend parallel to the axis of the rotors 11, 12, that it cannot tilt inside the input portion 2. Said walls are preferably adjustable in a direction perpendicular to said axis so that said walls can be brought close to corresponding surfaces of blocks of any dimension.

For proper operation it is required that the distance between said two walls, shown in cross-section in FIG. 2, is less than the distance between the axes between the rotors 11, 12.

While the blocks are guided in the input portion 2 they are brought on top of the rotors 11, 12 with the blades 22, 23 projecting out of the slots 20, 21 in this region inside the housing 1. The blades 22, 23 will then scrape slices from said blocks and convey the material removed from the blocks to the central region 33 and further to the outlet section of the housing 1 which leads into the output portion 3. The conveyed material will thereby be plastified and compressed homogeneously below the central region 33. The material will be output from output aperture 34 as an endless, very homogeneously, flexible layer, which can be brought onto an endless conveying belt, for instance on a layer of dough on said belt.

Preferably the dimensions of the output aperture 34 can be adjusted by means of a slide 35. By this the dimensions of the cross-section of the layer from aperture 35 can be adapted to the velocity of several devices, such as rotors 11, 12 and said endless conveying belt.

The scraper elements 31, 32 preferably have a concave bearing surface 36, 37 matching the circumference of the rotors 11, 12 so that good contact is obtained with the rotors 11, 12 and a good scraping action is ensured.

Since the scraper element 31, 32 should be situated as close as possible to the rotors 11, 12 to obtain optimum scraping action, it is preferable for the bearing surfaces 36, 37 of the scraper elements 31, 32 to be wider than the slots 20, 21 in order to obviate vibrations, for example, causing the scraper elements 31, 32 to stick in the slots 20, 21 during rotation of the rotors 11, 12.

Each blade 22, 23 preferably has a bevelled outer end surface 38, 39 with a direction such that the acute angles of the blades 22, 23 point in the direction of conveyance. By this said ends of the blades 22, 23 will show better grip and cut performances for the blocks which are on top of said rotors above said central region 33 and, in addition, will show a better conveying efficiency of said rotors, than for blades without bevelled outer ends.

An additional advantage of the apparatus according to the invention is, that the distance between the inner side walls 4, 5 of the housing 1 opposing the rotors 11, 12 is not of importance. Therefore the housing 1 can be manufactured cheap. Any soiling of the space there between rotors 11, 12 and said rotors, which is very unlikely to occur with the apparatus according to the invention, can be removed very easily.

What is claimed is:

1. Apparatus for producing an homogenous layer of flexible material from blocks of a highly consistent material, such as butter or margarine comprising:

(A) an upper input portion defining a vertical chute and having two pair of substantially vertical, parallel extending interconnected sidewalls; said sidewalls defining borders of a rectangular upper input opening and a rectangular lower output opening of said input portion; one of the two pair of sidewalls being of variable separation such as to guide in close relationship in a vertical direction said blocks which are to be input into the upper opening of said input portion;

(B) a central portion defining a pump housing and having at least one pair of substantially vertical parallel extending sidewalls; said central portion having a rectangular upper inlet section arranged opposite to and in alignment with the rectangular lower opening of said upper inlet portion, the edge of said housing inlet section in fixed coextensive contact with the edge of said lower output opening of the input portion; said pump housing also having a rectangular lower outlet section, two edges of said lower outlet section being defined by the edges of the parallel sidewalls of said central portion;

(C) a lower outlet portion defining a convergent vertical chute and having a rectangular upper inlet section arranged opposite to and in alignment with the rectangular lower output section of said central portion; the edge of said upper inlet section of the outlet portion being in fixed coextensive contact with the edge of said lower output section of the central portion; the outlet portion having two pairs of interconnected opposed sidewalls defining the border of said upper inlet section, at least one sidewall being convergant toward an opposite sidewall, the lower edges of the sidewalls defining a lower rectangular output opening of smaller parameter than the upper inlet section;

(D) a pair of elongate rotors within the central portion (B) and disposed in parallel in a substantially horizontal plane, said rotors extending longitudinally between the parallel sidewalls of central portion (B); axes of said rotors protruding through and retained by the parallel sidewalls of the central portion (B); said rotors aligned parallel to the lower rectangular output opening of the lower outlet portion (C) and also parallel to a pair of sidewalls of the upper input portion (A); the distance between axes of said rotors being greater than the distance between said pair of sidewalls of element (A); rotors rotable by a drive mechanism in synchronus contrarotation such that the half side of each rotor that faces the opposite rotor moves in rotation away from the upper input portion (A) and thus toward the lower outlet portion (C);

(E) elongate retractable and extendable blades disposed radially within said rotors (D) and freely movable in the radial direction within radial elongate slots longitudinally disposed in the rotors; said blades extending longitudinally between the parallel sidewalls of central portion (B);

(F) guide elements fixedly attached to each opposite longitudinal end of each blade (E); said elements moving in rotation within;

(G) eccentric loop-shaped grooves disposed at each rotor end and within the inside face of the parallel sidewalls of the central portion (B); said grooves thus determining the radial extension of the blades (E) and configured as to fully extend each blade (E) as it rotates toward the vertical and facing the upper input portion (A) and maintain the blade in full extension until the blade turns past the horizontal whereupon it is fully retracted into the rotor (D); said rotor blades (E), when fully extended, just registering with the opposite rotor as said blades pass the horizontal; additionally said blades alternately intermeshing in uniform spatial separation with blades of the opposite rotor;

(H) a pair of parallel elongate scraper elements extending between the parallel sidewalls of central portion (B), each scraper disposed parallel to a rotor (D) and fixedly attached to the bottom of central portion (B); along two parallel edges of the upper inlet section of the lower outlet portion (C); said scraper elements disposed to bear against a rotor (D);

(I) a lower conveying space defined by a fully extended horizontal blade (E), the rotors (D) and slots with blades (E), the scrapers (H), the parallel sidewalls of the central portion (B) and the lower outlet portion (C).

2. Apparatus according to claim 1, characterized in that the output portion comprises means to adjust the dimensions of the output opening thereof.

3. Apparatus according to claim 1, characterized in that the input portion comprises means to adjust the distance of said two sidewalls thereof to correspond with the dimension in the same direction of the blocks to be input.

4. Apparatus according to claim 1, characterized in that the angle included between each pair of adjacent blades of each of said rotors is greater than 30°.

* * * * *

UNITED STATES PATENT AND TRADEMARK OFFICE

CERTIFICATE OF CORRECTION

PATENT NO. : 4,584,934

DATED : April 29, 1986

INVENTOR(S) : Gijsbert De Fockert

It is certified that error appears in the above-identified patent and that said Letters Patent is hereby corrected as shown below:

At page one (1), item [30] Foreign Application Priority Data, cancel the date reading "Nov. 19, 1982" and insert in lieu thereof -- Jan. 12, 1982 --.

Signed and Sealed this

Seventeenth Day of February, 1987

*Attest:*

DONALD J. QUIGG

*Attesting Officer*

*Commissioner of Patents and Trademarks*